US007047723B2

(12) United States Patent
Martling et al.

(10) Patent No.: US 7,047,723 B2
(45) Date of Patent: May 23, 2006

(54) APPARATUS AND METHOD FOR REDUCING THE HEAT RATE OF A GAS TURBINE POWERPLANT

(76) Inventors: Vincent C. Martling, 10296 Sandy Run Rd., Jupiter, FL (US) 33478; Zhenhua Xiao, 195 Lone Pine Dr., Palm Beach Gardens, FL (US) 33420

( * ) Notice: Subject to any disclaimer, the term of this patent is extended or adjusted under 35 U.S.C. 154(b) by 0 days.

(21) Appl. No.: 10/836,971

(22) Filed: Apr. 30, 2004

(65) Prior Publication Data

US 2005/0241317 A1 Nov. 3, 2005

(51) Int. Cl.
*F23R 3/44* (2006.01)

(52) U.S. Cl. ..... 60/39.37; 60/722

(58) Field of Classification Search ..... 60/805, 60/722, 39.37, 798, 751, 752; 415/211.2, 415/182.1, 207, 208.1
See application file for complete search history.

(56) References Cited

U.S. PATENT DOCUMENTS

| | | | | |
|---|---|---|---|---|
| 4,255,927 | A * | 3/1981 | Johnson et al. | 60/39.23 |
| 4,704,869 | A * | 11/1987 | Iizuka et al. | 60/751 |
| 4,979,361 | A | 12/1990 | Clark et al. | |
| 5,351,474 | A * | 10/1994 | Slocum et al. | 60/39.23 |
| 5,387,081 | A | 2/1995 | LeBlanc | |
| 5,603,604 | A | 2/1997 | Norris et al. | |
| 5,632,141 | A | 5/1997 | Sloop et al. | |
| 5,737,915 | A | 4/1998 | Lin et al. | |
| 2003/0010014 | A1 * | 1/2003 | Bland et al. | 60/39.37 |

* cited by examiner

*Primary Examiner*—Ehud Gartenberg

(57) ABSTRACT

The present invention provides an apparatus and method for reducing the pressure loss of air prior to entering a combustion system, such that, for a known combustion system having a predetermined pressure loss, the resulting fluid entering the turbine has a higher supply pressure that will result in more efficient turbine and increased engine output. Significant enhancements include the addition of a plurality of deflector assemblies to direct the air from a compressor outlet towards an exposed single-wall transition duct to provide direct cooling to a first panel of the transition duct.

6 Claims, 5 Drawing Sheets

APPARATUS AND METHOD FOR REDUCING THE HEAT RATE OF A GAS TURBINE POWERPLANT

TECHNICAL FIELD

This invention primarily applies to gas turbine engines used to generate electricity and more specifically to a method and apparatus for reducing the heat rate and improving the overall efficiency.

BACKGROUND OF THE INVENTION

Operators of gas turbine engines used in generating electricity at powerplants desire to have the most efficient operations possible in order to maximize their profitability and limit the amount of emissions produced and excess heat lost. In addition to maintenance costs, one of the highest costs associated with operating a gas turbine at a powerplant, is the cost of the fuel burned in the gas turbine, either gas, liquid, or coal. For example, a gas turbine engine that operates on natural gas and is designed to produce approximately 170 MW of electricity when operated at base load, or full power throughout the year, typically consumes about 15.4 billion standard cubic feet of natural gas in a year. Increasing the efficiency of the gas turbine will result in an increase in electrical generation capacity for a given amount of fuel burned. Alternatively, if additional electrical generation is not possible or desired, the required level of electricity can be generated at a lower fuel consumption rate. Under either scenario the powerplant operator achieves a significant cost savings while simultaneously increasing the powerplant efficiency.

Attempts have been made to optimize the efficiency of the engine through compressor and turbine airfoil enhancements, improved combustor cooling, as well as attempts to provide uniform flow to combustor components. An example of a combustion system for the prior art gas turbine engine discussed above is shown in cross section in FIG. 1. The combustion system 10 receives its air for mixing with fuel from a compressor outlet 11, which flows into a large plenum 16 adjacent to a plurality of can annular combustion systems. The air is intended to cool the outer walls of combustion system 10, including impingement cooled transition duct 12, which includes an outer impingement sleeve 13.

However, the geometry of the compressor discharge case 14 does not sufficiently direct the air from compressor 15 towards combustion system 10, and the air unnecessarily loses some of its supply pressure.

An attempt to provide the impingement cooled transition duct 12 with a more uniform flow of air is provided in prior art U.S. Pat. No. 5,737,915. A tri-passage diffuser is positioned at the compressor exit to direct the flow into the compressor discharge case in a more uniform pattern in attempt to recover static pressure of the cooling fluid prior to entering an impingement sleeve surrounding a transition duct. While this device may provide a more uniform flow to an impingement cooled device, it does not maximize the pressure recovery possible prior to entering the combustion system, which is a key element to improved engine efficiency and performance.

A significant way to increase the gas turbine engine performance is to provide the turbine with a higher supply pressure. For a combustion system having a known pressure loss, this can be accomplished by reducing the pressure losses to the air that occurs in the region between the compressor outlet and the combustion chamber.

SUMMARY AND OBJECTS OF THE INVENTION

The present invention seeks to address the problems in the prior art by providing an apparatus and method for reducing the pressure loss of the air prior to entering a combustion system, such that, for a known combustion system having a predetermined pressure loss, the resulting fluid entering the turbine has a higher supply pressure, resulting in a more efficient turbine. In accordance with a preferred embodiment of the present invention, a gas turbine engine is provided comprising an axial compressor, an inner compressor discharge case proximate the compressor outlet, a plurality of combustors arranged in an annular array about the engine, and a turbine coupled to the compressor. The combustors include an outer case, a flow sleeve positioned within the outer case, a combustion liner positioned within the flow sleeve, an end cover having a plurality of fuel nozzles fixed to the outer case, and an exposed single-wall transition duct in fluid communication with the combustion liner. The exposed single-wall transition duct is positioned such that air from the compressor outlet is directed towards a first panel to provide direct cooling similar to a cylinder in cross flow geometry. The air is directed from the compressor outlet towards the transition duct by a deflector assembly comprising an inner deflector that is fixed to a first portion of the inner compressor discharge case and extends generally radially outward and an outer vane that is fixed to a second portion of the compressor discharge case.

It is an object of the present invention to provide an apparatus for reducing the pressure loss associated with a compressor outlet and cooling of a transition duct for a gas turbine engine.

It is another object of the present invention to provide a method of reducing the heat rate for a gas turbine engine by decreasing the pressure drop associated with a compressor outlet and cooling of a transition duct.

In accordance with these and other objects, which will become apparent hereinafter, the instant invention will now be described with particular reference to the accompanying drawings.

DETAILED DESCRIPTION OF THE PREFERRED EMBODIMENT

Figure 3:
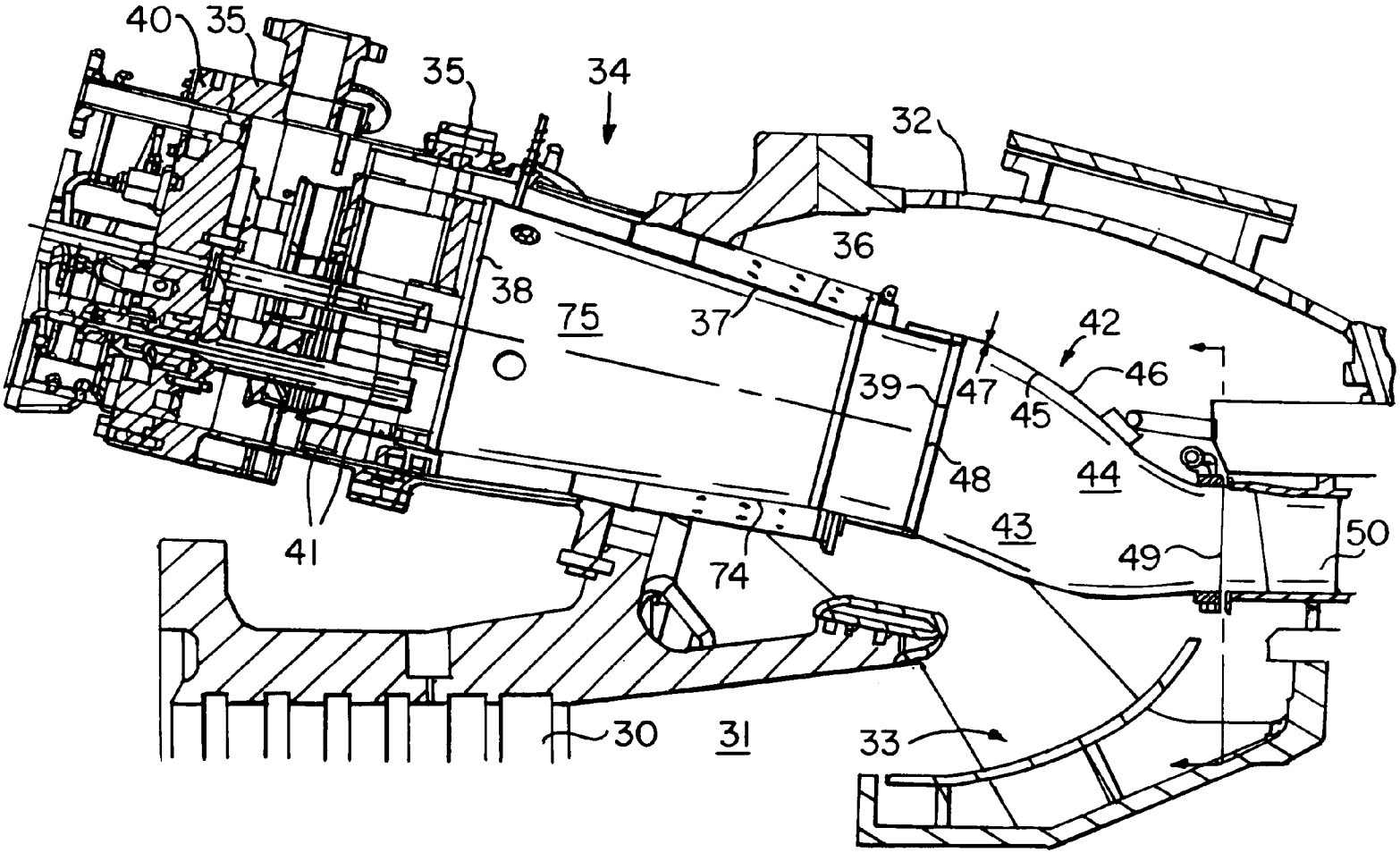
FIG. 3 is a cross section of a combustion system in accordance with the preferred embodiment of the present invention.

The preferred embodiment of the present invention is shown in cross section in FIG. 3. The present invention includes an apparatus and method for reducing the pressure drop and corresponding heat rate for a gas turbine engine with the apparatus comprising an axial compressor 30 that is coupled to an axially extending shaft (not shown) with compressor 30 having a compressor inlet (not shown) and a compressor outlet 31. Positioned proximate compressor outlet 31 for receiving air from compressor 30 is a compressor discharge case 32. Case 32 also incorporates a means for directing air 33 from compressor outlet 31 away from the compressor shaft and towards a plurality of combustors 34. The plurality of combustors is arranged in a generally annular array about the shaft, fixed to compressor discharge case 32, and comprise an outer case 35, a flow sleeve 36 positioned radially within outer case 35, and a combustion liner 37 positioned radially within flow sleeve 36 with combustion liner 37 having a liner inlet 38 and liner outlet 39. Fixed to outer case 35 is an end cover 40 that includes a plurality of fuel nozzles 41 for injecting fuel into combustion liner 37 proximate liner inlet 38. In fluid communication with combustion liner 37 is an exposed single-wall transition duct 42 comprising a first panel 43 and a second panel 44 that are fixed together to form a duct having an inner wall 45, an outer wall 46, a thickness 47 therebetween, a generally cylindrical duct inlet 48, and a generally rectangular duct outlet 49. As used herein, the term "exposed single-wall transition duct" means a transition duct 42 that has at least one panel (e.g first panel 43) that is directly cooled without the use of an impingement sleeve. The cooling of transition duct 42 is improved as a result of the air from compressor outlet 31 being directed towards first panel 43 of transition duct 42 to provide direct cooling of first panel 43. Coupled to the axially extending shaft, and for driving compressor 30, is a turbine 50. Specific details of compressor 30 and turbine 50 have been removed for clarity purposes as the proposed invention focuses on enhancements to the region proximate combustors 34.

Figure 4:
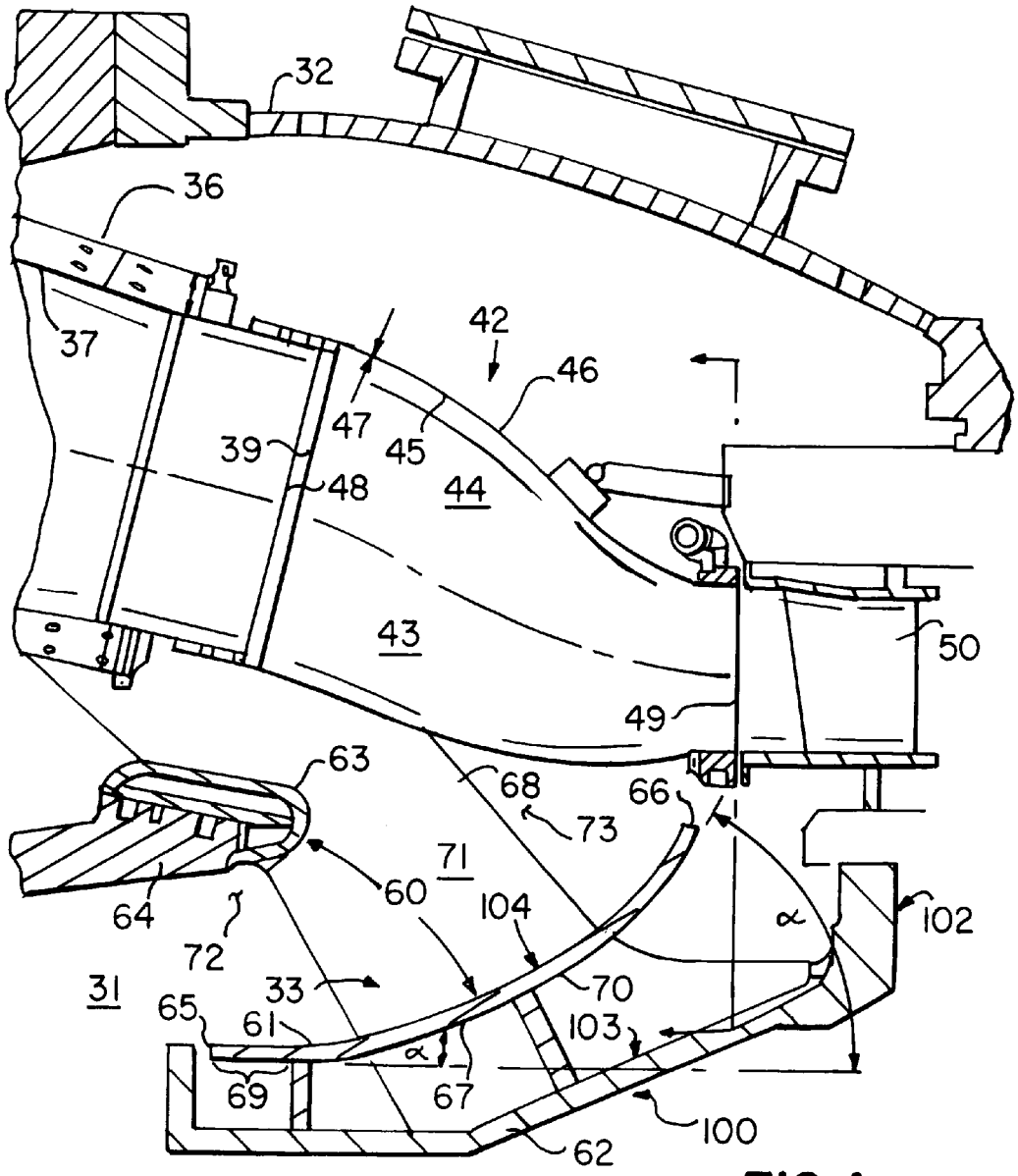
FIG. 4 is a detailed cross section of a portion of the inner compressor discharge case and combustion system in accordance with the preferred embodiment of the present invention.

While the overall gas turbine engine having a lower pressure loss and associated lower heat rate has been described in general terms with reference to FIG. 3, a more detailed description of the enhancements to compressor discharge case 32 and combustor 34 will now be provided. Referring now to FIG. 4, the inner compressor discharge case 100, having a compressor discharge end 101, a turbine inlet end 102 opposite said compressor discharge end 101, and a radially outer surface 103 extending therebetween, and the components related thereto, are shown in greater detail. More specifically, the preferred embodiment of the present invention incorporates a plurality of deflector assemblies 60 as means for directing air away from the shaft. Deflector assemblies 60 each comprise an inner deflector 61 fixed to said radially outer surface 103 at a first portion 62 of the inner compressor discharge case 100, and an outer vane 63 fixed to a second portion of the compressor discharge case 64. Inner deflector 61 extends generally radially outward and has a first inner deflector end 65, a second inner deflector end 66, and a deflector surface 67 extending therebetween. In order to provide the most effective cooling to transition duct 42, each transition duct 42 has a deflector assembly 60 for turning the compressed air from compressor outlet 31. For the preferred embodiment of the present invention, fourteen deflector assemblies are required and are located adjacent combustors 34 and in between compressor discharge struts 68.

Figure 1:
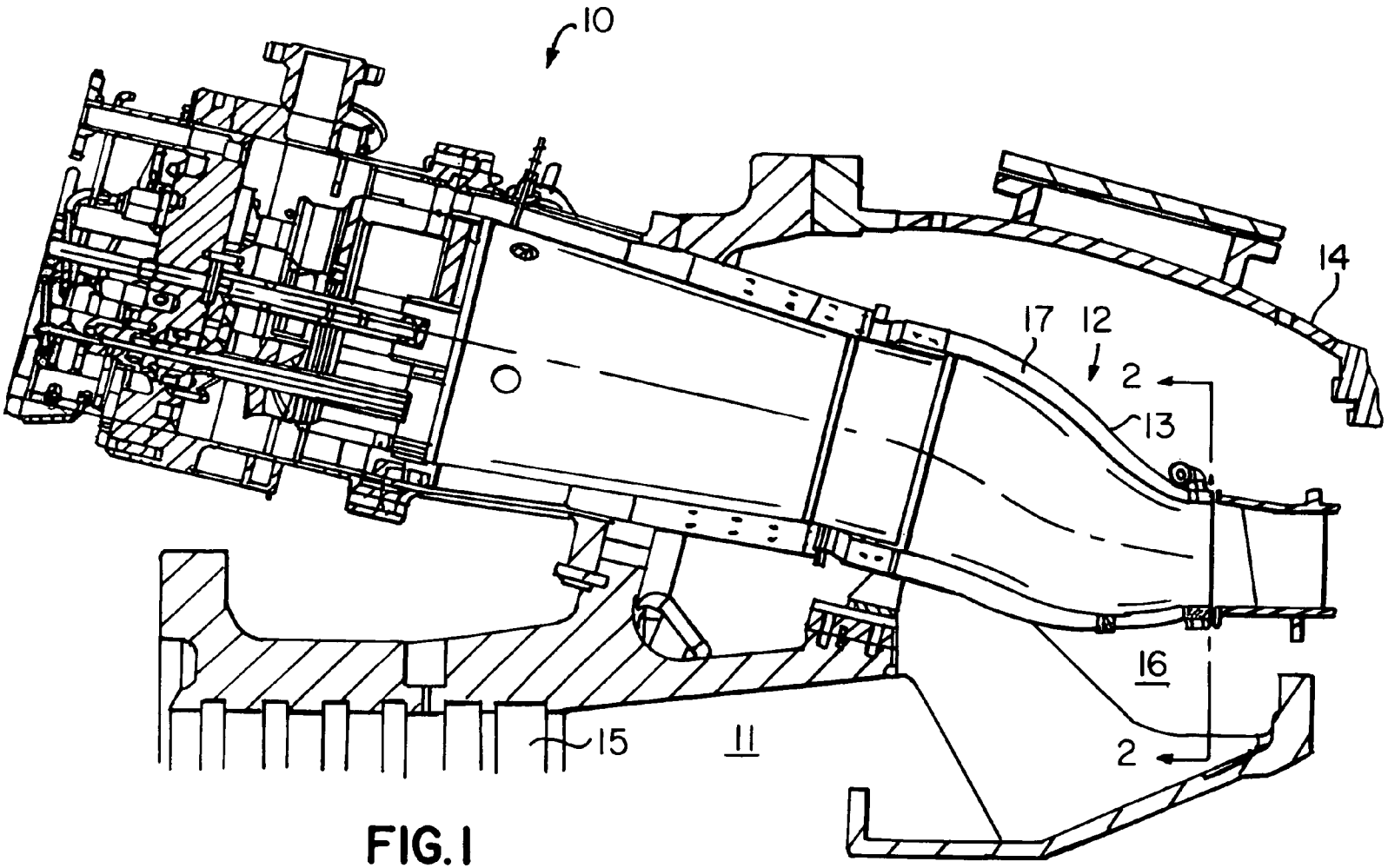
FIG. 1 PRIOR ART
FIG. 1 is a cross section of a combustion system of the prior art.

Referring back to the prior art gas turbine shown in FIG. 1, air from compressor 15 passes through compressor outlet 11 and flows ambiguously through plenum 16 before entering cooling channel 17, which is formed between impingement sleeve 13 and the inner wall of transition duct 12. Impingement sleeve 13 is provided to direct discrete jets of cooling air from plenum 16 onto the inner wall of transition duct 12. While this arrangement does provide for sufficient cooling to the transition duct inner wall, the plurality of holes 18 in impingement sleeve 13 creates a substantial drop in air supply pressure. Analysis of a gas turbine engine of the prior art concluded that pressure losses occurring from compressor outlet 11 and the impingement sleeve 13 can reach as much as 1.5% of the total supply pressure exiting compressor 15. This pressure drop lowers the air supply pressure to the combustor and turbine, resulting in reduced efficiency and turbine performance.

Referring back to FIG. 4, deflector assemblies 60 address this pressure loss by providing a smooth transition for air from compressor outlet 31 and direct this flow of air towards transition duct 42. Inner deflector 61 of deflector assembly 60 includes a first inner deflector portion 69 that extends from inner deflector end 65 and is substantially parallel to the shaft, and a second inner deflector portion 70 that extends from inner deflector end 66 and is at an angle $\alpha$ relative to the shaft. It is preferred that angle $\alpha$ is between 10 and 70 degrees and that inner deflector 61 is positioned axially such that it terminates at second inner deflector end 66 forward of transition duct outlet 49. Outer vane 63 works in conjunction with inner deflector 61 to direct the air from compressor outlet 31. Outer vane 63 is positioned axially proximate first inner deflector end 65 and radially outward of inner deflector 61 such that a deflector channel 71 is formed therebetween and has a channel inlet 72 and a channel outlet 73. The deflector channel expands from channel inlet 72 to channel outlet 73 in order to ensure that the air from compressor 30 is directed towards transition duct first panel 43 at a lower velocity than at compressor outlet 31 in order to provide direct cooling along the outer wall of first panel 43. Directing the flow in this manner, towards transition duct first panel 43, allows for the elimination of impingement sleeve 13 from the prior art and reduction in pressure loss associated with plurality of holes 18 in impingement sleeve 13.

Figure 2:
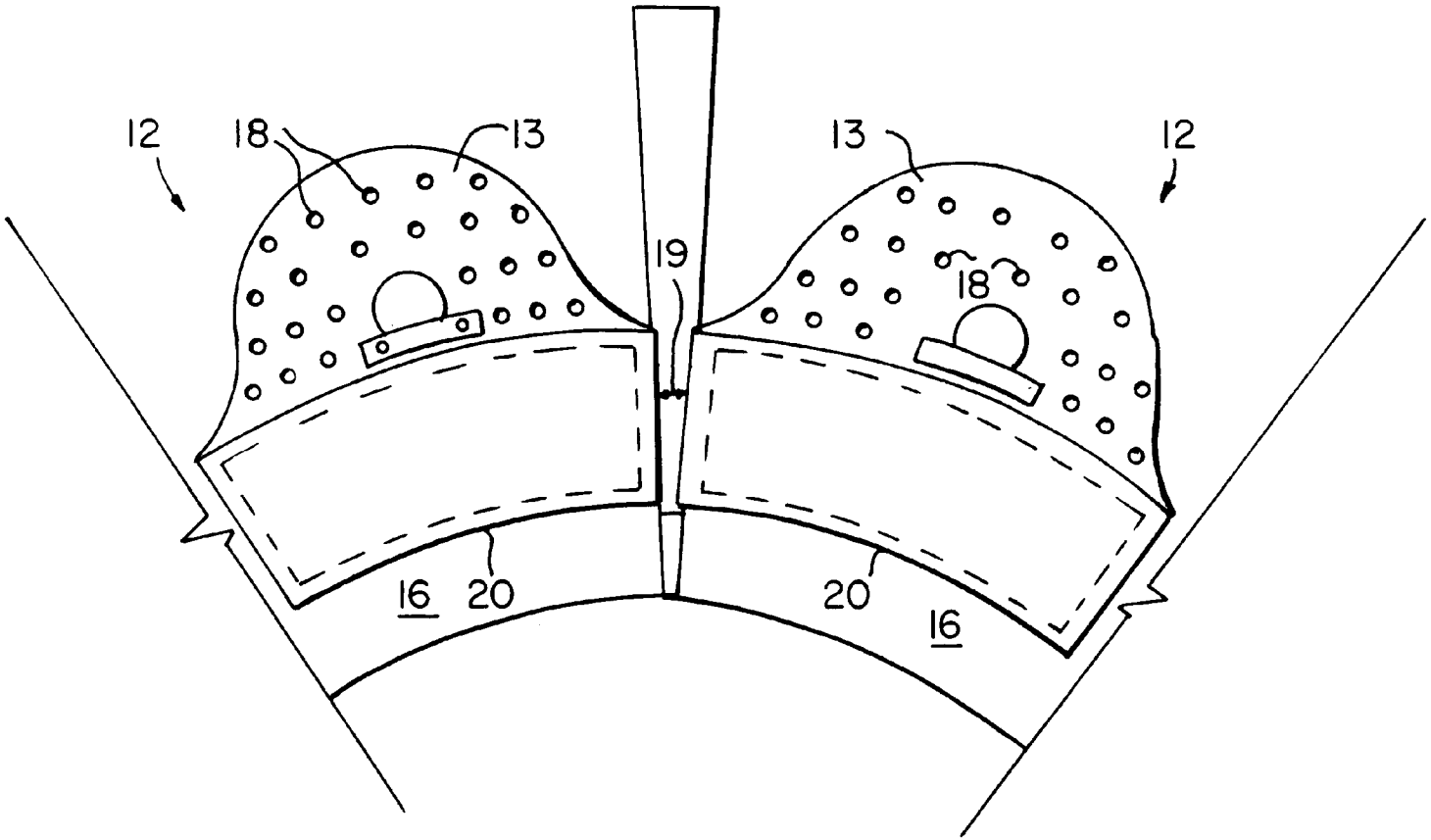
FIG.2 PRIOR ART
FIG. 2 is an end view looking forward at the outlet end of adjacent transition ducts in accordance with a combustion system of the prior art.
Figure 5:
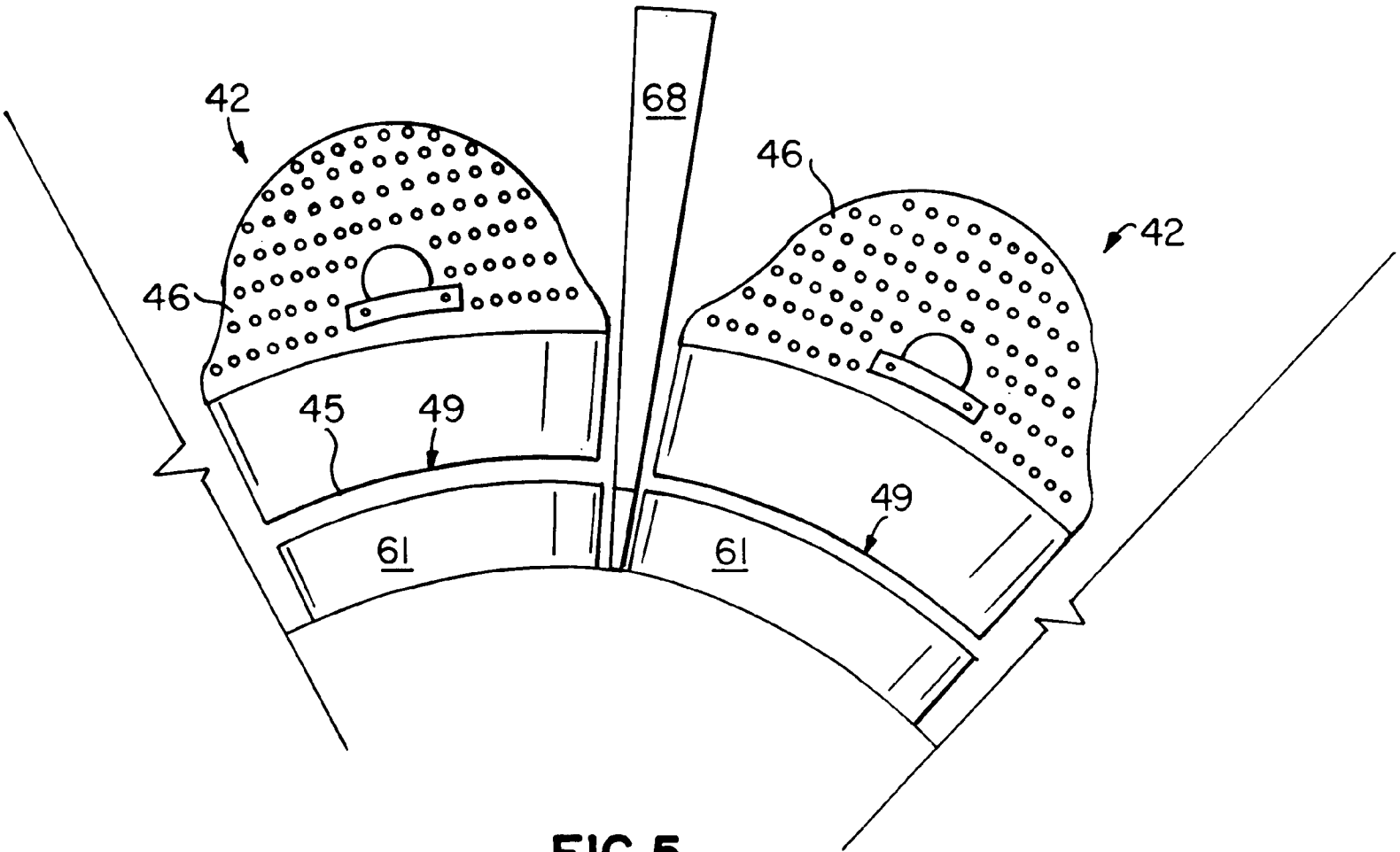
FIG. 5 is an end view looking forward at the outlet end of adjacent transition ducts in accordance with the preferred embodiment of the present invention.

Removal of impingement sleeve 13 of the prior art also affects the cooling characteristics between adjacent transition ducts. Referring back to FIG. 2, a first gap 19 exists between adjacent transition duct outlets 20 of the prior art. Increasing the gaps between adjacent transition ducts through removal of impingement sleeves 13, as can be seen in FIG. 5, allows an increase of airflow and results in lower pressure loss due to reduced flow blockage in between adjacent 42.

The addition of deflector assemblies 60 and modifications to transition duct 42, including the removal of impingement sleeve 13, results in an estimate total pressure recovery of approximately 1.5%, with over half of that air pressure recovery attributed to direct cooling of the first panel 43 of transition duct 42 through removal of impingement sleeve 13. The remainder of the air pressure recovery is due to the use of deflector assemblies 60 and the increased gap in between adjacent transition ducts without impingement sleeves.

In addition to the apparatus necessary to reduce air pressure loss to a combustion system for a gas turbine engine, a method for decreasing the pressure drop across a combustion system and correspondingly reducing the heat rate for a gas turbine engine is also disclosed. Referring to FIGS. 3–5, the method comprises a plurality of steps including providing a gas turbine engine comprising an axial compressor 30 coupled to an axially extending shaft (not shown) where compressor 30 has a compressor inlet (not shown) and a compressor outlet 31. Positioned proximate compressor outlet 31 for receiving air from compressor 30 is an inner compressor discharge case 100. Fixed to the inner compressor discharge case 100 is a means for directing air 33 from compressor outlet 31 away from the compressor shaft and towards a plurality of combustors 34. The plurality of combustors is arranged in a generally annular array about the shaft, fixed to compressor discharge case 32, and comprise an outer case 35, a flow sleeve 36 positioned radially within outer case 35, and a combustion liner 37 positioned radially within flow sleeve 36 with combustion liner 37 having a liner inlet 38 and liner outlet 39. Fixed to outer case 35 is an end cover 40 that includes a plurality of fuel nozzles 41 for injecting fuel into combustion liner 37 proximate liner inlet 38. In fluid communication with combustion liner 37 is single-wall transition duct 42 comprising a first panel 43 and a second panel 44 that are fixed together to form a duct having an inner wall 45, an outer wall 46, a thickness 47 therebetween, a generally cylindrical duct inlet 48, and a generally rectangular duct outlet 49. The cooling of transition duct 42 is improved as a result of the air from compressor outlet 31 being directed towards first panel 43 of transition duct 42 to provide direct cooling of first panel 43. Coupled to the axially extending shaft, and for driving compressor 30, is a turbine 50. Specific details of compressor 30 and turbine 50 have been removed for clarity purposes.

Having been provided with a gas turbine engine with the aforementioned features, air is then directed from compressor outlet 31 away from the shaft and towards first panel 43 of transition duct 42 to provide direct cooling of first panel 43 such that heat is transferred from first panel 43 to the air. Next, a portion of the air is directed around transition duct 42 to provide cooling to second panel 44 with the heat from second panel 44 being transferred to the portion of air. Finally, the remaining air is directed along combustion liner outer wall 74 for cooling combustion liner 37 and then into a combustion chamber 75 for mixing with fuel from plurality of fuel nozzles 41.

As previously mentioned, the enhancements regarding the apparatus and method utilized for directing air from the compressor outlet to the combustion system, results in approximately 1.5% reduction in pressure loss. This additional air pressure supply to the combustion system and turbine, increases the efficiency of the engine for a given fuel consumption rate, or the previous output can be achieved by burning less fuel. In terms of gas turbine engines designed to drive a generator for generating electricity, this increased air pressure supply results in improved efficiency and a lower heat rate for the engine, a mark by which gas turbines in the power industry are measured. More specifically, the gas turbine engine described in the preferred embodiment, having fourteen combustion systems and fourteen deflector assemblies, lowers its heat rate by approximately 1.5% when utilizing this invention. For a gas turbine engine operating at baseload, or full power for an extended period of time, this reduction in heat rate can lower fuel costs by up to $1.1 million annually while improving engine performance.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A gas turbine engine having reduced pressure drop and a lower heat rate, said gas turbine engine comprising:

an axial compressor coupled to an axially extending shaft said compressor having a compressor inlet and a compressor outlet;

an inner compressor discharge case positioned proximate said compressor outlet for receiving air from said compressor, said compressor discharge case having a compressor discharge end, a turbine inlet end opposite said compressor discharge end, and a radially outer surface extending therebetween, and means for directing said air from said compressor outlet away from said shaft said means attached to said radially outer surface;

a plurality of combustors arranged in an annular array about said shaft and fixed to said compressor discharge case, each of said combustors comprising:

an outer case;

a flow sleeve positioned radially within said outer case;

a combustion liner positioned radially within said flow sleeve and having a liner inlet and liner outlet;

an end cover fixed to said outer case, said end cover including a plurality of fuel nozzles for injecting fuel into said combustion liner proximate said liner inlet;

an exposed single-wall transition duct in fluid communication with said combustion liner, said transition duct comprising a first panel and a second panel, said first panel fixed to said second panel thereby forming a duct having an inner wall, an outer wall, a thickness therebetween, a generally cylindrical duct inlet, and a generally rectangular duct outlet;

a turbine coupled to said axially extending shaft for driving said axial compressor; and, wherein said air from said compressor outlet is directed towards said first panel of said transition duct to provide direct cooling to said first panel of said transition duct;

said means for directing said air away from said shaft comprises a plurality of deflector assemblies;

each of said deflector assemblies comprises: an inner deflector fixed to said radially outer surface of said inner compressor discharge case and extending generally radially outward, said inner deflector having a first inner deflector end, a second inner deflector end, and a deflector surface extending therebetween, said deflector surface including a first inner deflector portion extending from said first inner deflector end and a second inner deflector portion extending from said second inner deflector end;

and, wherein said inner deflector is positioned axially such that said first inner deflector end is located adjacent but disconnected from said compressor discharge end, and said second inner deflector end is located adjacent but disconnected from said duct outlet.

2. The gas turbine engine of claim 1 wherein said plurality of deflector assemblies comprises fourteen assemblies.

3. The gas turbine engine of claim 1 wherein each of said deflector assemblies is located between compressor discharge struts.

4. The gas turbine engine of claim 1 wherein said first inner deflector portion is substantially parallel to said shaft and said second inner deflector portion is at an angle a, of between 10 degrees and 70 degrees to said shaft.

5. The gas turbine engine of claim 1 wherein each of said deflector assemblies further comprises an outer vane fixed to a second portion of said compressor discharge case, said outer vane is positioned axially proximate said inner deflector portion and radially outward thereof to form a deflector channel therebetween, said deflector channel having a channel inlet and a channel outlet.

6. The gas turbine engine of claim 5 wherein said deflector channel expands from said channel inlet to said channel outlet.

* * * * *